United States Patent [19]

Arad

[11] 4,212,465

[45] Jul. 15, 1980

[54] PINBALL GAME WITH PLURAL RE-PROJECTORS ACTUABLE BY SINGLE SOLENOID ACTED UPON BY SINGLE SWITCH

[75] Inventor: Avi Arad, New York, N.Y.

[73] Assignee: Louis Marx & Co., Inc., Stamford, Conn.

[21] Appl. No.: 885,132

[22] Filed: Mar. 9, 1978

Related U.S. Application Data

[63] Continuation of Ser. No. 779,300, Mar. 21, 1977, abandoned.

[51] Int. Cl.[2] ..... A63D 3/02; A63D 13/00

[52] U.S. Cl. ..... 273/121 A; 273/123 A; 273/129 V

[58] Field of Search ..... 273/121 R, 121 A, 119 R, 273/119 A, 129 HA, 122 R, 122 A, 123 R, 123 A, 125 A; 200/60.11

[56] References Cited

U.S. PATENT DOCUMENTS

| | | | |
|---|---|---|---|
| 2,088,258 | 7/1937 | Breitenstein | 273/122 A |
| 2,101,201 | 12/1937 | Simpkins | 273/121 A |
| 2,184,866 | 12/1939 | Radtke | 273/121 A |
| 2,317,506 | 4/1943 | Williams et al. | 273/123 A |
| 2,507,716 | 5/1950 | Hughes | 273/118 A |
| 2,642,290 | 6/1953 | Moloney et al. | 273/118 A |
| 2,864,620 | 12/1958 | Hooker et al. | 273/124 A |
| 3,467,389 | 9/1969 | Scholin et al. | 273/179 A |
| 3,472,513 | 10/1969 | Bizouard | 273/129 HA |
| 3,627,318 | 12/1971 | Garbary | 273/127 D |
| 3,675,927 | 7/1972 | Gottlieb et al. | 273/119 A |
| 3,865,376 | 2/1975 | Glass et al. | 273/125 A |
| 3,874,665 | 4/1975 | McCulloch et al. | 273/179 A X |
| 4,097,047 | 6/1978 | Ochi | 273/129 HA |
| 4,109,916 | 8/1978 | Breslow et al. | 273/121 A |

*Primary Examiner*—Richard T. Stouffer
*Attorney, Agent, or Firm*—Blum, Kaplan, Friedman, Silberman & Beran

[57] ABSTRACT

A pinball game in which several rear re-projectors are actuatable by a single solenoid which is acted upon by a single switch for re-directing the ball toward the back of a playing surface. Each movable element includes a lost motion connection, whereby when a ball contacts a given re-projector, only that re-projector will be actuated by the single solenoid.

13 Claims, 5 Drawing Figures

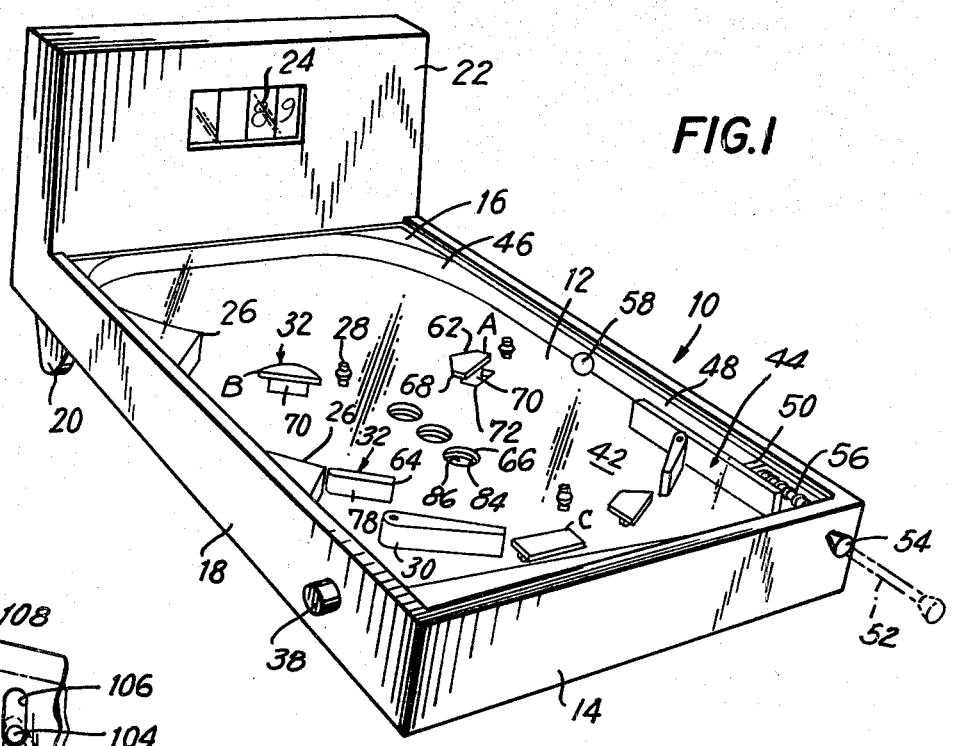
FIG.1
FIG.5
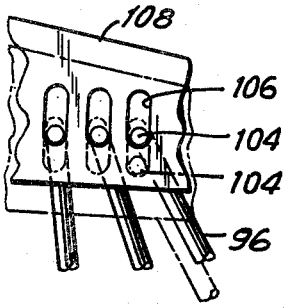
FIG.2
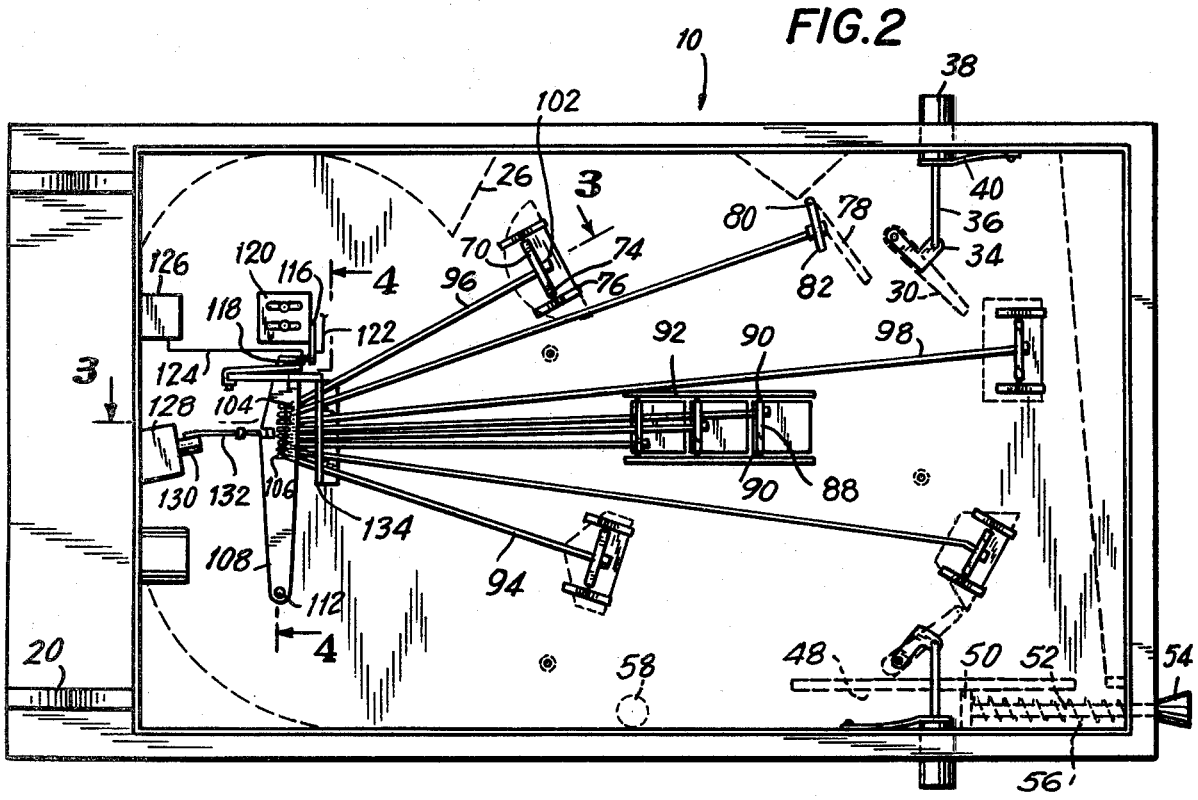

PINBALL GAME WITH PLURAL RE-PROJECTORS ACTUABLE BY SINGLE SOLENOID ACTED UPON BY SINGLE SWITCH

This is a continuation of application Ser. No. 779,300 filed Mar. 21, 1977, now abandoned.

BACKGROUND OF THE INVENTION

1. Field of the Invention

A pinball game including plural rear re-projectors.

2. Description of the Prior Art

Originally, bagatelle games, i.e. pinball games, were quite simple. They included a forwardly and downwardly sloping playing surface. Several balls were included which were arranged to be projected along a side of the game from the front toward the rear after which they would roll back toward the front, striking impediments during their downward travel. The playing surface usually was provided with various pockets of different values and with various pins or bumpers to randomly alter the movement of rolling balls.

The games have become more sophisticated with the passage of time, and among the complex variations was the provision of rear re-projectors which, when touched by a descending ball, re-projected the ball toward the rear of the game, thus prolonging the play of each ball. Frequently, a ball would be rearwardly re-projected several times during its play before reaching an out-of-play position. Rear re-projection was accomplished by a movable impediment on the playing surface. For example, the impediment might be an oscillatable lever sometimes known as a "flipper," or it might be a circular bumper which was capable of rocking or expanding in such a manner as to force the ball back toward the rear of the game, or it might be a non-circular bumper which was capable of rocking and was provided with a sensing element that would cause the bumper to move in such a fashion as to snap the ball back toward the rear of the game. These rear re-projectors, which also may be referred to as supplemental rear projectors to distinguish them from the principal rear projector that comes into use each time a fresh ball is introduced on the table for play thereof, were characterized by the provision of a separate solenoid for each of them. The solenoid was energized each time that a ball struck the impediment, the actuation of the solenoid causing the operation of the rear re-projector to be effected.

The use of such plural solenoids has substantially added to the cost and maintenance of pinball games and has greatly discouraged the inclusion of supplemental rear re-projectors in low cost pinball games, particularly in pinball games designed for domestic use.

So far as the present inventor is aware, there are no prior patents that disclose the use of a single solenoid for energization of plural individual rear re-projectors which are struck by a ball rolling down a sloping pinball playing surface. The only patent of which the inventor is cognizant that might even be considered to be relevant is Simpkins, U.S. Pat. No. 2,101,201 in which a pinball apparatus is shown that includes several hurdles in each of which a downwardly rolling ball may be trapped from time to time, each hurdle being provided with a forward projector, the purpose of which is to flip the ball over the hurdle on its way to the front of the game. The energization of all of the flipping structures is provided by a single solenoid.

SUMMARY OF THE INVENTION

1. Purposes of the Invention

It is an object of the invention to provide a pinball game employing several rear re-projectors energized by a single solenoid.

It is another object of the invention to provide a game of the character described in which each rear re-projector, upon being engaged by a ball, operates a motion transmission means singular to such projector, all of the motion transmission means being structured to close a single switch that energizes a solenoid which reverses the direction of the motion transmission means and causes the rear re-projector to flip the ball toward the rear of the game.

It is another object of the invention to provide a game of the character described in which there is a lost motion connection between each of the rear re-projectors and the single switch so that the rear re-projector which is engaged by the ball is energized by the solenoid without energizing other rear re-projectors through their transmission means.

It is another object of the invention to provide a game of the character described which constitutes relatively few and simple parts, can be maintained easily and is relatively inexpensive to make.

Other objects of the invention in part will be obvious and in part will be pointed out hereinafter.

2. Brief Description of the Invention

A bagatelle game embodying the present invention includes a playing surface which slopes upwardly from the front to the rear so that a ball will roll down from the rear toward the front of the game. The game includes a principal rear projector which will snap a ball from near the front of the game to the rear of the game, after which the ball will roll forwardly and downwardly over the sloping playing surface. During its descent, the ball may strike various scoring means which are no part of the invention, and various impediments such as bumpers, pins, barricades and the like which are no part of the invention and which are conventional to bagatelle games.

Pursuant to the present invention, the playing surface also is provided with sundry rear re-projectors. These rear re-projectors may assume many forms. Typical forms are bumpers, flippers and openings. Each one of the rear re-projectors has associated with it a movable element that can be directly or indirectly engaged and moved by a downwardly rolling ball and which, when engaged, will shift from a first position to a second position. Each such movable element is mechanically connected to one end of a different transmission means. The other ends of the several transmissions means are connected to a common member like a beam. The connection is such that when the movable element of any given rear re-projector is engaged by a ball the common member is moved. The common member is moved in the same direction by each movable element of each ball rear re-projector when that movable element is contacted by a ball. The common member operates a normally open switch; that is to say, when the common member is moved upon the ball engaging any one of the movable elements of any one of the rear re-projectors, the switch is closed. The switch is in the electrical actuating circuit for a solenoid. When the solenoid is energized upon closure of the switch, it will snap the common member away from the position to which it has been moved by any one of the transmission means and, in so snapping the common member, it will shift the transmission means in a direction reverse to that in which the transmission means was moved upon engagement of the movable element of a given rear re-projector upon contact of that element by a ball. When the transmission means moves the movable element in a reverse direction, since it is tied to the rear re-projector, it actuates the rear re-projector which, in turn, snaps the ball rearwardly. Hence, the single solenoid and the single switch and single common member function for all of the rear re-projectors, the multiplying of parts only being required in conjunction with the transmission of the movement of the movable element from the rear re-projector to the common member and the reverse movement of the transmission means to actuate the rear re-projector. Thus, it will be appreciated that the transmission means operates in both directions, one in a sensing direction to, in effect, trip the solenoid, and the other in a power direction to, in effect, snap the rear re-projector.

In a preferred form of the invention a lost motion connection is provided between the rear re-projectors and the common member so that, upon engagement of a ball with any given rear re-projector, that rear re-projector only will be in operative engagement with the common member while the remainder of the rear re-projectors will be out of operative engagement with the common member whereby, upon actuation of the common member by energization of the solenoid, it will only operate one of the rear re-projectors, this being the rear re-projector engaged by the ball during its downward path of travel.

The rear re-projectors, which constitute flippers, bumpers and the like, are mounted for movement in a direction having a substantial vector (component) in a front-to-back direction. Where the rear re-projector is associated with an opening, the movable element thereof will be a member which may have a substantial vector perpendicular to the playing surface of the game and a small vector in a front-to-back direction. However, regardless of the particular front-to-back vector associated with any given rear re-projector, the ball invariably, pursuant to this invention, will be thrown rearwardly thereby, i.e. toward the rear and away from the front of the game, in order to prolong the play of any particular ball. Quite apparently, throwing the ball back toward the rear of the game will shift the ball closer to its original point of descent from the rear of the game.

The game further may include various lights and moving parts to add to the excitement and activity experienced when the game is played, and scoring means to impart an element of competition when two or more players use the game, or to set a mark of achievement for an individual player.

The invention consists in the features of construction, combinations of elements and arrangements of parts which will be exemplified in the device hereinafter described and of which the scope of application will be indicated in the appended claims.

BRIEF DESCRIPTION OF THE DRAWINGS

In the accompanying drawings in which is shown one of the various possible embodiments of the invention:

FIG. 1 is a perspective view of a bagatelle game incorporating rear re-projectors embodying the present invention;

FIG. 2 is a bottom view of the bagatelle game shown in FIG. 1;

FIG. 5 is an enlarged fragmentary top view taken substantially along the line 5—5 of FIG. 4.

PREFERRED EMBODIMENT OF THE INVENTION

Figure 3:
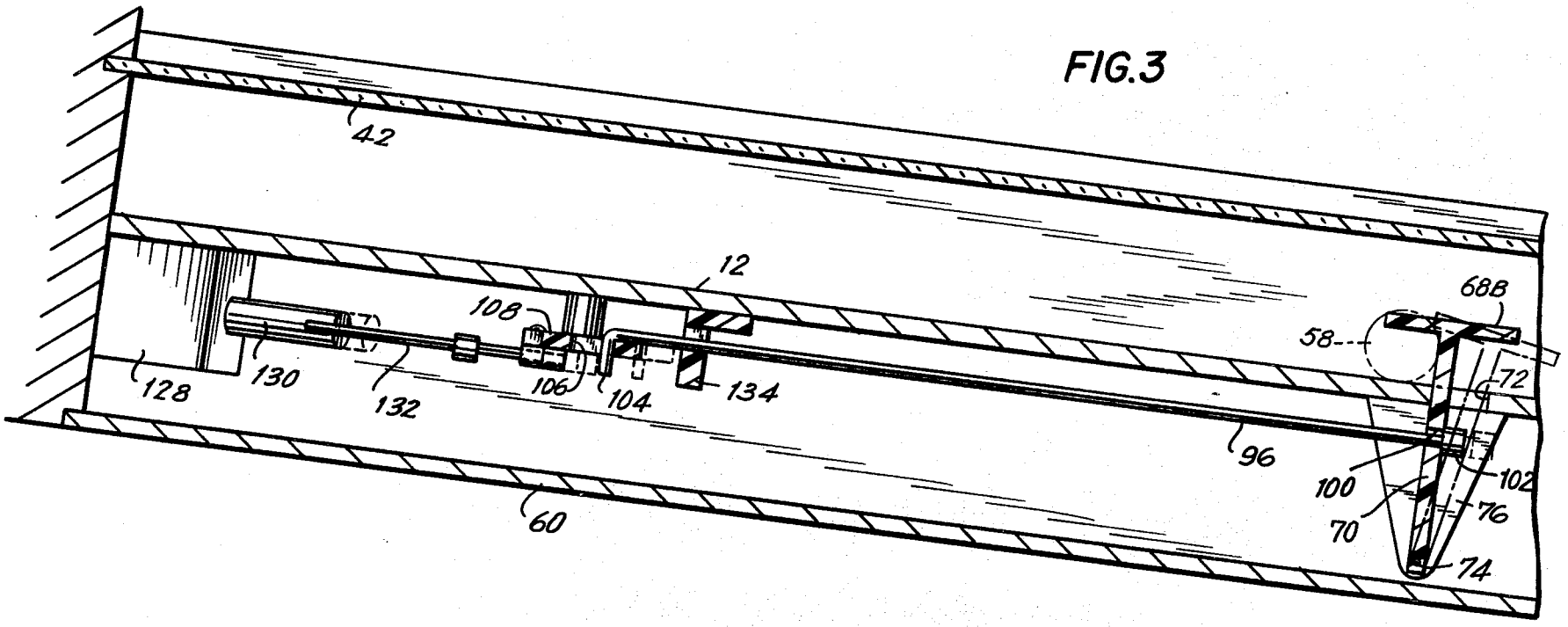
FIGS. 3 and 4 are fragmentary enlarged perspective views taken substantially along the lines 3—3 and 4—4 of FIG. 2.
Figure 4:
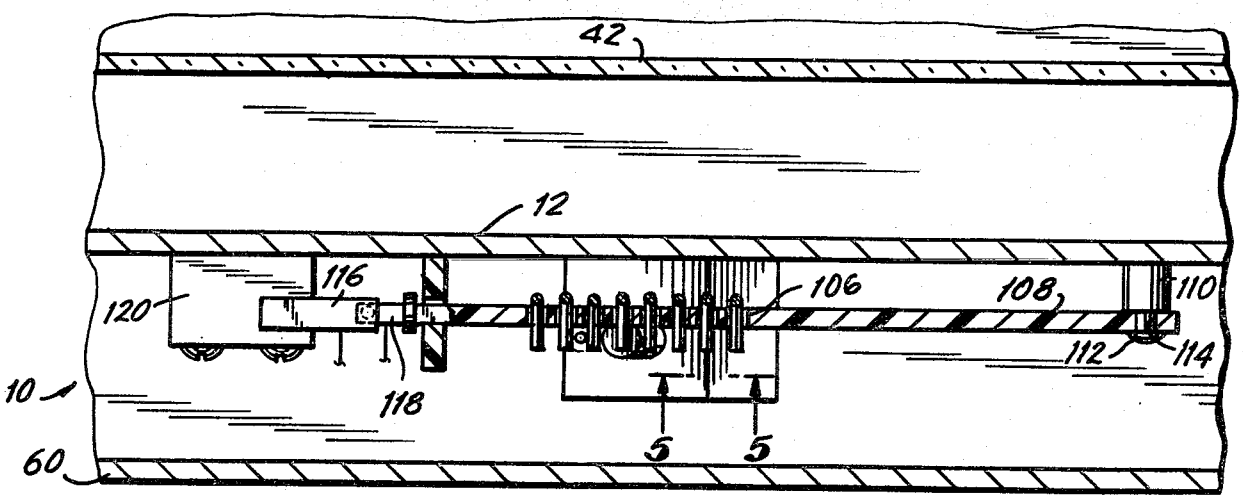

Referring now in detail to the drawings, the reference numeral 10 denotes a pinball, i.e. bagatelle, game utilizing rear re-projectors incorporating the principle of the present invention. The game includes a playing surface 12 which slopes upwardly from the front 14 to the rear 16 of the game. The game also includes a casing 18 which may be supported on legs, or which may have the lower edge of its front 14 resting on a flat horizontal surface while the rear of the casing is elevated as by stub legs 20.

The present invention is adapted to be used with a game that is designed to be placed in a commercial establishment. It also may be used with a game designed to be sold as a toy for use in a home. The game illustrated is of a particularly simple variety, not having a plurality of various sophisticated mechanisms incorporated on its playing surface and thus is more readily adaptable for use as a toy in a home.

The game also includes a raised back panel 22 having a scoring means 24 thereon which is actuated in a conventional fashion by circuitry and a source of power (not shown).

The playing surface 12 is tilted downwardly from rear to front in order to encourage rolling downward movement of a ball. The ball in such travel may encounter various types of impediments of which there are illustrated herein only four different kinds for the purpose of simplicity. No other kinds of impediments are shown but they may, of course, be employed. The impediments here shown are stationary side deflectors 26, stationary bumpers 28, manually actuatable flippers 30 and rear re-projectors, i.e. auxiliary rear projectors 32. These latter are triggered and actuated in accordance with the present invention.

The deflectors 26 simply are fixed immovable blocks placed at various strategic locations on the playing surface and designated to intercept various possible paths of movements of balls as they travel from the rear to the front of the playing surface. Typically, the deflectors 26 present downwardly inclined edges to the ball so that a ball, upon striking such an edge, will roll down the edge and thus change the downward path of travel of the ball which may have been planned by a player. Such deflectors add a random factor to the play of the game. The deflectors may be placed at sides of the playing surface as shown, or they may be placed between the sides of the playing surface out in the open, so to speak.

The bumpers 28 as illustrated constitute pins which carry elastomeric rings so that, when struck by a ball, the ball will rebound slightly with no added impetus save that acquired by its own momentum which first is absorbed by the ring and then is re-imparted to the ball. The bumpers may be small, as indicated, or they may be quite large in diameter.

The bumpers and deflectors quite apparently present surfaces at a height such that they will be struck by a ball rolling down the playing surface. The bumpers and deflectors preferably are struck by a great circle of the ball girding a horizontal plane through the ball at a major diameter thereof.

The flippers 30 constitute levers, each mounted at one end to turn about axes perpendicular to the plane of the playing surface. The flipper levers are oriented to extend downwardly and inwardly from their mounting axes so that when the flippers are actuated by a player and energized at the proper moment that a ball just has contacted them, they will propel the ball back up the playing surface toward the rear 16. Typically, a flipper has a bell crank 34 located below the playing surface (see FIG. 2), one arm of which is connected by a link 36 to a push button 38 a portion of which extends through an opening in a side wall of the casing so that its free tip can be pressed by an operator's fingertip. The push button is biased outwardly to a position corresponding to the idle position of the flipper by a flat contilever mounted spring 40.

To prevent a player from interfering with the downward movement of a ball over the playing surface, a transparent pane 42, e.g. of glass or plastic, is secured to the casing and completely covers the playing surface.

It may be mentioned that, although not shown, many other types of impediments can be provided on the playing surface. For example, the playing surface may include chutes, spinners, large circular bumpers, coil springs, etc. which, as indicated previously, have not been illustrated in the game 10 inasmuch as they are not necessary to the instant invention, namely, a novel system of rear re-projectors 32.

Also as is customary in pinball games, a primary rear projector 44 is included, the purpose of which is to initially, i.e. at the beginning of the play of each ball, propel a ball from adjacent the front 14 of the game 10 to the rear 16 thereof. A primary deflector 46 is mounted on the playing surface, the same being positioned to change the direction of movement of a ball propelled rearwardly by the primary rear projector. The primary deflector assumes control of the path of travel of the ball shortly after it leaves the projector and directs the path transversely. The point at which a ball will leave the deflector will depend upon the velocity of the ball at the time of its primary rear projection.

The primary rear projector includes a channel 48 open at the rear and customarily located along one side wall of the casing. Said projector also includes a plunger 50 which is slidable in the channel 48 and can be drawn back by rearward movement of a shaft 52 terminating in a knob 54. A coil spring 56 is trapped between the plunger 50 and the front 14 of the casing. When the knob 54 is pulled rearwardly, a ball 58 resting on the rear of the plunger will follow the plunger toward the front of the game. Energy is stored up in the spring. When an operator releases the knob, the stored energy will propel the ball rearwardly in the manner described above.

Although not shown, balls are fed to the rear of the plunger, one at a time, under the control of the user by any standard replenishing mechanism such as is found in pinball games. These mechanisms are coin-controlled where the game is used in a commercial establishment, and may be slug-controlled for domestic use, or the ball replenishing mechanism may be actuated simply by manipulation of a movable member where the game is used in a home.

The game also may include various switches in association with some or all of the impediments in order to provide a pleasing display or lighting and in order to actuate the scoring means 24. The scoring, of course, will depend upon the skill of a player in manipulating the knob 54 or in jostling of the game so as to influence the path of travel of the ball as it rolls down the playing surface.

The game further includes a bottom wall 60 below the playing surface 12. The bottom wall serves to protect the various mechanisms associated with the sundry impediments on the playing surface 12. Thus, the playing surface is protected top and bottom by the transparent pane 42 and by the bottom wall 60.

In accordance with the present invention, one or more rear re-projectors 32 are provided in association with the playing surface 12. These projectors can be variously located on the playing surface. There is no fixed pattern which must be employed to effect the invention. Their positioning, specific structure and appearance will be governed by esthetic appearances and the preferred degree of complexity that is desired to impart to the game.

Three different kinds of rear re-projectors 32 have been illustrated. They are commonly characterized by the provision in each re-projector of a movable element so mounted that it can move between two positions, namely, a rear position and a front position, a portion of the movable element which is designed to be contacted by a ball rolling down the playing surface being in the rear position before it is contacted by a ball, being moved by the ball from the rear position to the front position under the weight and momentum of the ball, the front position being a cocked position, and the movable element finally snapping back to its rear position thereby imparting movement to the ball in a direction having a vector from the front to the back of the game so that the ball, upon operation of the rear re-projector, is propelled toward the rear of the game to freshly start a new downward path of movement over the playing surface. It is to be emphasized that, pursuant to the present invention, the movable element of each rear re-projector must have a component with a front-to-back vector.

The three types of rear re-projectors here shown include a bumper type rear re-projector 62, a flipper type rear re-projector 64, and a trap type rear re-projector 66.

A bumper type rear re-projector is typified by the inclusion of a bumper 68 which is a member having a portion thereof at a level above the playing surface a distance equal to the radius of a ball. The bumper is so located that it can be struck by a ball rolling down the playing surface. The bumper is small enough to be struck by some balls and missed by others. The bumper has a portion of its periphery facing rearwardly and it is this portion which will be struck by a ball rolling down the playing surface. The portion which is struck can be of various configurations. The bumper 62 at the right-hand rear side of the playing surface has three linear portions that face rearwardly at different angles to a downwardly rolling ball. The bumper at the upper left-hand side of the playing surface has a semi-circular rearwardly facing portion. The bumper at the lower center portion of the playing surface has a rearwardly facing edge which is substantially parallel to the front of the game. These three bumpers have been denoted in the sequence mentioned by the reference letters A, B and C.

Each bumper is supported on a standard 70 that extends from the bumper through an opening 72 in the playing surface 12. The lower portion of each standard includes oppositely extending registered trunnions 74 that are journaled in bearings of cradles 76 that project downwardly from the playing surface 12. The standards thereby are mounted for oscillatory movement thereof and of the bumpers about axes of rotation beneath and parallel to the underside of the playing surface 12 and having a substantial component parallel to the front 14. This oscillatory movement enables the bumpers 62 to move in a direction having a front-to-rear vector, as described above, so that each bumper can shift from a rear to a front position through an arc of movement.

It is appropriate to mention at this point that such shifting movement of the bumpers from a rear, to a front, back to a rear position characterizes rear re-projection bumpers of this type, the movement from rear to front being against the action of a rear biasing means such as a light spring. Each bumper of the prior art conventionally has had associated therewith its own individual solenoid and its own individual triggering means of some type such as a normally open switch that, upon closure, completed a circuit from a source of power such as a domestic AC outlet or a battery to the solenoid to energize the same and cause the solenoid to move sharply in a fashion such, through a suitable transmission means, as to snap the bumper from its front back to its rear position and, in so doing, to rearwardly propel, i.e. project, the ball that was momentarily in contact with the bumper.

The second type of rear re-projector 64, i.e. the flipper type, constitutes a lever 78, one end of which is attached to a shaft 80 that is journaled in a bearing opening (not shown) in the playing surface. The shaft extends downwardly through the playing surface where it is fixed to an operating lever 82. The inactive rear position of the lever 78 is illustrated in FIG. 1. In this position the lever extends in an inclined fashion from its upper left-hand end to its lower right-hand end. Thereby when the lever is deflected forwardly by a ball rolling down the playing surface and thereafter is forced back to its rear position, the lever has a vector with a component extending from front to rear and, hence, will propel a ball striking its surface back toward the rear 16 of the game. In the prior art, this propulsion was achieved by an individual solenoid for each such flipper type rear re-projector, the actuating circuit for the solenoid being triggered, i.e. closed, by movement of the lever 78 from its rear to its front position.

This leaves for description the trap type rear re-projector 66. As shown herein, each such rear re-projector includes an opening 84 in the playing surface. The game may have as many of these trap type rear re-projectors as deemed desirable. In the game here shown there are three of them arranged in a front-to-back line and in close proximity to one another, the line extending perpendicularly to the front 14. Each said rear re-projector includes a platform 86 below its associated opening 84. The upper surface of the platform is inclined to the horizontal, the front portion of the platform being higher than the rear portion of the platform. Each platform has at its front edge a downwardly depending leg 88. Each leg includes a pair of oppositely extending trunnions 90 below the playing surface. The trunnions are journaled in a cradle 92, one cradle being common to all the platforms of the three trap type rear re-projectors. Thus, each platform is mounted for oscillatory movement from an idle, to a depressed, and back to an idle position. The axis of oscillation of each platform is parallel to the wall 14, this being only examplificative. In the prior art, trap type rear re-projectors were each provided with their own solenoid. When a ball dropped on a platform it would depress it against a light spring to close an energizing circuit for the solenoid which would snap the platform back to its starting position and, in so doing, throw the ball upwardly and rearwardly due to the initial front-to-rear downward inclination of the platform. The force exerted by the solenoid was adjusted so that a ball falling into the foremost opening 66 might be thrown into the intermediate opening and then into the rearmost opening and then rearwardly from the rearmost opening, or variations could be incorporated to change the amount of rearward re-projection of the ball from any one or more of the openings.

It should be mentioned that, although not shown, all of the rear re-projectors, and indeed other impediments, may be provided with associated switches that are closed when the impediments are struck by a ball so as to feed pulses to the scoring means 24 or to various illuminating elements around the playing surface. Such scoring and illumination means are standard and therefore need not be shown or detailed.

It is the primary feature of the present invention to have all of the rear re-projectors actuated by a single common solenoid through plural transmission means, a different one for each of the rear re-projectors, all of the transmission means operating in two directions, a first direction to transmit motion from the rear re-projector movable element when the latter is struck by a ball so as to cause the solenoid to be actuated, and a second direction to transmit motion from the solenoid to the movable element of the rear re-projector. Thereby when a ball impinges on the movable element of any rear re-projector, the single common solenoid will be actuated to cause said movable element to propel the impinging ball rearwardly over the playing surface.

The sundry transmission means for the various rear re-projectors 62, 64, 66 are, as illustrated, identical in their general construction although different in their specific dimensions and supports. Typical transmission means for the different bumper type rear re-projectors 62A, B and C constitute rods 94, 96 and 98, respectively. The connections for the transmission means essentially are similar and therefore the description of one should serve for the balance. The rod 96, for example, has its front end extending through an opening 100 in the support 70. The projecting portion of the front end has a collar 102 fast thereon. The rear end of the rod 96 has a downwardly turned finger 104 that is received in and projects downwardly from a slot 106 in a common trigger beam 108 that extends transversely across the game near the rear thereof beneath the playing surface 12 and above the bottom wall 60. There are several of these slots 106 which are provided in the trigger beam side by side and generally mutually parallel, although exact parallelism is not a necessary criterion. Means is included to mount the trigger beam for front-to-rear movement. Said means conveniently constitutes a post 110 which receives a pin 112 that extends through an opening 114 near one end of the trigger beam. It will be appreciated that if the rod 96 is shifted from its full line position shown in FIG. 3 to its dot-and-dash line position shown in the same figure, the shifting being accomplished by forward movement of the bumper 68B, the beam will be shifted by the rod from the full line position of the beam shown in FIGS. 3 and 5 to the dot-and-dash line position of said beam in the same figures. In other words, the beam will be oscillated in a forward direction about the pin 112. Movement of any one of the bumpers upon engagement therewith by a downwardly rolling ball will occasion a similar forward shifting movement of the associated transmission rod 94, 96 or 98 in a forward direction with the corresponding movement of the trigger beam. In other words, regardless of which rear re-projector has its movable element contacted by a downwardly rolling ball, the trigger beam will be shifted forwardly.

Forward movement of the trigger beam closes a normally open switch having a stationary contact 116 and a movable contact 118. The stationary contact is carried by an adjustable block 120 secured to the underside of the playing surface 12, and the movable contact 118 is carried by the trigger beam 108 (see FIG. 2). These two contacts are in registry and, in idle position of the beam 108, are spaced from each other. The contacts 116, 118 are connected by leads 122, 124 to a source of electric power such as a battery 126 which is mounted on the underside of the playing surface 12. If desired, the battery can be replaced by a source of electric power which derives its energy from a nearby electrical convenience outlet.

The trigger beam 108 is kinematically connected to a single common linear electric motor 128, e.g. a solenoid, having an armature 130. The armature normally is in extended position, being held thereat by a light spring. When the solenoid is actuated upon closure of the normally spaced contacts 116, 118, it will retract the armature into the solenoid coil against a restoring force exerted by the light spring, and in so doing, will, through a rod 132, pull the beam rearwardly. The rod 132 is pivotally connected at one end to the armature and at the other end to the beam. The beam is snapped sharply rearwardly a short distance upon energization of the solenoid and, when this occurs, it will sharply snap the corresponding transmission rod 94 rearwardly which will cause the movable element of the corresponding rear re-projector to snap rearwardly to impart an abrupt rearward movement to the ball in contact with this projector whereby the ball will be propelled toward the rear of the playing surface, this being the purpose of the rear re-projector.

The sundry transmission rods 94, 96, 98 slidably rest near their rear ends on a bridge bar 134 supported from the underside of the playing surface.

The physical connections between the rear re-projectors and the rear ends of the associated transmission rods, and between the trigger beam and the front ends of the transmission rods, can be direct connections, such a connection being one which causes movement of one element when an element directly connected thereto moves. In this event, all of the rear re-projectors would be tied together for joint movement through their transmission rods and the common trigger beam. Although such an arrangement is within the ambit of the present invention, it is not particularly desirable inasmuch as it will stiffen and make more difficult the movement of any given rear re-projector responsive to contact by a downwardly rolling ball, and it also will require a heavier duty solenoid since the solenoid will have to snap all of the rear re-projectors rearwardly because every one of them will have been moved forwardly when any one of them is contacted by the ball. Therefore, it is preferable that lost motions be introduced into the individual kinematic means interconnecting each rear re-projector with the common trigger beam.

Most conveniently, lost motion is introduced at either the forward end of the transmission rod where the transmission rod is interconnected with the associated rear re-projector, or at the forward end of the transmission rod where the transmission rod is connected to the common trigger beam. Indeed, the lost motion connection at the rear end of the transmission rod already has been described; it constitutes the slot 106 in which the downwardly turned finger 104 is freely slidable in a front-to-back direction. The lost motion at the front end of the transmission rod constitutes the slidable reception of the front end of the transmission rod in the downwardly extending portion of the associated rear re-projector, e.g. in the standard 70, the operating lever 82 or the leg 88. Due to the provision of such lost motion, when a forwardly rolling ball contacts a rear re-projector and moves the same to its forward position (see, for example, the dot-and-dash lines in FIG. 3), the corresponding finger 104 will pull the common trigger beam 108 forwardly, but the remaining fingers 104 of all the other transmission rods will remain in their idle position, simply resting on the bridge bar 134. This differential of position of the fingers 104 is illustrated in FIG. 5 where the right-hand finger is illustrated in dot-and-dash lines as being shifted forwardly, while the remaining fingers in full lines, which are to the left of the dot-and-dash line finger 104, remain in their original positions which now are spaced from the forward ends of their corresponding slots 106. Thereby when the solenoid 120 is actuated, the only transmission rod which will be sharply snapped rearwardly will be the transmission rod associated with the forwardly displaced finger 104 and, therefore, the only rear re-projector which will be suddenly snapped rearwardly will be the rear re-projector associated with the actuated finger 104. Thus, the total force of the solenoid will be utilized in snapping this single rear re-projector rearwardly and the only rear re-projector which will be snapped rearwardly will be that one which has been moved forwardly by the rolling ball. The remaining rear re-projector and their transmission rods are quiescent.

It thus will be seen that there is provided a game which achieves the various objects of the invention and which is well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense.

Having thus described the invention there is claimed as new and desired to be secured by Letters Patent:

1. A pinball game including:

(A) a playing surface sloping downwardly from the rear to the front thereof;

(B) a transparent cover above said surface;

(C) a casing for said cover and said surface;

(D) at least one ball;

(E) a primary rear projector for propelling a ball from near the front of the playing surface toward the rear thereof so as to permit the ball to roll down over the playing surface toward the front;

(F) impediments on the playing surface in positions to be struck at random by a downwardly rolling ball;

(G) at least plural of said impediments including rear re-projectors;

(H) each of said rear re-projectors including a movable element and means supporting said element for movement between a front position and a rear position;

(I) said movable element, when moving between said two positions, having a component of motion in a front-to-back directions; and (J) means to actuate each rear re-projector upon contact therewith of a ball rolling down over the playing surface, said machine including an improvement comprising: the provision for said actuating means of (I) a single solenoid, (II) an energizing circuit for the solenoid, (III) a common normally open switch in the energizing circuit which is closed when any rear re-projector is moved from its rear position to its front position, (IV) a common member, (V) means mounting the common member for movement in a front-to-rear direction, and (VI) a different motion transmission means interconnecting each rear re-projector with the common member, (VII) each said motion transmission means transmitting forward motion of the associated rear re-projector when contacted by a ball rolling downwardly over the playing surface of the game, said motion transmission means being operatively connected with said switch whereby the motion of the motion transmission means operates to close said switch and actuate said solenoid, and said motion transmission means transmitting a sudden rearward motion of the common member to the rear re-projector when the solenoid is energized; each motion transmission means including lost motion means whereby when a ball contacts a given rear re-projector, it alone will move the common member and it alone will be snapped forwardly by the common member upon closure of the switch.

2. A pinball game as set forth in claim 1 wherein a lost motion means is interposed between each motion transmission means and its associated rear re-projector.

3. A pinball game as set forth in claim 2 wherein a lost motion means is interposed between each motion transmission means and the common member.

4. A pinball game as set forth in claim 1 wherein a lost motion means is interposed between each motion transmission means and the common member.

5. A pinball game as set forth in claim 1 wherein at least one of the impediments includes a bumper and is mounted for rotation about a horizontal axis parallel to the playing surface and at an angle to the front-to-rear direction.

6. A pinball game as set forth in claim 1 wherein at least one of the impediments includes a lever and is mounted for rotation about an axis perpendicular to the playing surface.

7. A pinball game as set forth in claim 1 wherein at least one of the impediments includes an opening in the playing surface and a member under said opening mounted for rotation about an axis parallel to the playing surface.

8. A pinball game as set forth in claim 1 wherein each motion transmission means includes a different rod extending from the associated rear re-projector to the common member.

9. A pinball game as set forth in claim 8 wherein the common member has a different slot for each rod, each rod having a portion thereof extending through the slot to provide a lost motion connection between the common member and the tnransmission rod.

10. A pinball game as set forth in claim 9 wherein each rear re-projector has an opening therein through which the front of the associated transmission rod extends to provide a lost motion connection between each transmission rod and its associated rear re-projector.

11. A pinball game as set forth in claim 8 wherein each rear re-projector has an opening therein through which the front of the associated transmission rod extends to provide a lost motion connection between each transmission rod and its associated rear re-projector.

12. A pinball game comprising:

a playing surface sloping downwardly from the rear to the front thereof;

at least one ball;

primary rear projector means for propelling a ball from near the front of the playing surface towards the rear thereof so as to permit the ball to roll down over the playing surface;

a plurality of rear re-projectors including a movable element and means supporting said element for movement between a front position and a rear position on said playing surface for impeding the ball as the ball rolls down over the playing surface and for propelling said ball towards the rear of said playing surface when one of said re-projector means is contacted by said ball;

a solenoid;

a normally open energizing circuit for the solenoid;

a common normally open switch which is closed for completing the circuit in response to a ball contacting one of said rear re-projector means;

a common member adapted for displacement in a front-to-rear direction connected to and displaceable by said solenoid; and motion transmission means for individually connecting each said rear re-projector means to said common member and for transferring forward motion of the associated rear re-projector when contacted by a ball rolling downwardly over the playing surface of the game, said motion transmission means being operatively connected with said switch through said common member whereby the motion of the motion transmission means from any of said rear re-projectors operates to operate said switch and actuate said solenoid;

said solenoid displacing said common member when the circuit is completed in response to a ball contacting one of said rear re-projectors thereby moving at least said rear re-projector means contacted by said ball towards the rear of said playing surface to said ball rearwardly.

13. The pinball game of claim 12, wherein each said motion transmission means are directly connected to said common member and the associated rear re-projectors whereby each said rear re-projector is displaced when one of said rear re-projectors is contacted by said ball and when said solenoid is actuated.

* * * * *